US010933639B2

(12) United States Patent
Kim et al.

(10) Patent No.: US 10,933,639 B2
(45) Date of Patent: Mar. 2, 2021

(54) INK JET RECORDING HEAD USING ADHESIVE SHEET AND METHOD OF MANUFACTURING THE SAME

(71) Applicant: CANON KABUSHIKI KAISHA, Tokyo (JP)

(72) Inventors: Songhee Kim, Tokyo (JP); Tomohiro Takahashi, Yokohama (JP); Isao Imamura, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 112 days.

(21) Appl. No.: 16/280,223

(22) Filed: Feb. 20, 2019

(65) Prior Publication Data

US 2019/0263122 A1 Aug. 29, 2019

(30) Foreign Application Priority Data

Feb. 28, 2018 (JP) ..... JP2018-034902

(51) Int. Cl.

| | |
|---|---|
| ***B41J 2/045*** | (2006.01) |
| ***B41J 2/16*** | (2006.01) |
| ***B41J 2/175*** | (2006.01) |
| *B41J 2/14* | (2006.01) |

(52) U.S. Cl.

CPC ..... *B41J 2/1623* (2013.01); *B41J 2/175* (2013.01); *B41J 2/14024* (2013.01); *B41J 2002/14491* (2013.01); *B41J 2202/13* (2013.01); *B41J 2202/22* (2013.01)

(58) Field of Classification Search

CPC ..... B41J 2/1623; B41J 2/175; B41J 2202/22; B41J 2202/13; B41J 2002/14491; B41J 2/1753; B41J 2/1752

See application file for complete search history.

(56) References Cited

U.S. PATENT DOCUMENTS

| | | | | |
|---|---|---|---|---|
| 6,241,340 | B1 * | 6/2001 | Watanabe | B41J 2/14024 347/50 |
| 6,992,117 | B2 | 1/2006 | Shimomura et al. | |
| 7,074,273 | B2 | 7/2006 | Shimomura et al. | |
| 7,399,502 | B2 | 7/2008 | Shimomura et al. | |
| 7,425,057 | B2 | 9/2008 | Harada et al. | |

(Continued)

FOREIGN PATENT DOCUMENTS

| | | | |
|---|---|---|---|
| JP | 2002-331666 | * 11/2002 | B41J 2/045 |
| JP | 2002-344130 | * 11/2002 | H05K 3/38 |

(Continued)

OTHER PUBLICATIONS

Machine translation of JP 2007-296707, published on Nov. 2007.*
Machine translation of JP 2002-344130, published on Nov. 2002.*

*Primary Examiner* — Huan H Tran
(74) *Attorney, Agent, or Firm* — Venable LLP

(57) ABSTRACT

In an ink jet recording head including an electric wiring substrate having an electric contact terminal for receiving an electric signal from an ink jet apparatus, an electric wiring tape which electrically connects the electric wiring substrate and a recording element substrate to each other, and an adhesive sheet which fixes the electric wiring substrate and the electric wiring tape to each other, the electric wiring tape and the electric wiring substrate are fixed to each other with the adhesive sheet containing a polyester resin and an epoxy resin.

8 Claims, 6 Drawing Sheets

(56) References Cited

U.S. PATENT DOCUMENTS

| | | | | |
|---|---|---|---|---|
| 7,566,758 | B2 | 7/2009 | Shimomura et al. | |
| 8,439,483 | B2 | 5/2013 | Kihara et al. | |
| 9,254,661 | B2 | 2/2016 | Otaka et al. | |
| 2008/0113184 | A1 * | 5/2008 | Yoshida | H05K 3/386 428/332 |

FOREIGN PATENT DOCUMENTS

| | | | | |
|---|---|---|---|---|
| JP | 2006-253570 | * | 9/2006 | H05K 3/46 |
| JP | 2007-296707 A | | 11/2007 | |
| WO | WO 2011/129278 | * | 10/2011 | H05K 3/386 |

* cited by examiner

INK JET RECORDING HEAD USING ADHESIVE SHEET AND METHOD OF MANUFACTURING THE SAME

BACKGROUND OF THE INVENTION

Field of the Invention

The present invention relates to an ink jet recording head using an adhesive sheet and a method of manufacturing an ink jet recording head.

Description of the Related Art

An ink jet recording head in the related art includes a recording element substrate which ejects ink, a support substrate which supports and fixes the substrate, and an electric wiring substrate which transmits an ejection signal to the recording element substrate, and the like. Electric connection between the recording element substrate and the electric wiring substrate is protected from corrosion by ink and an external impact by bonding the substrate to the electric wiring tape, and sealing the bonded electric connecting portion with a sealing agent.

In Japanese Patent Application Laid-Open No. 2007-296707, in an ink jet recording head having a support substrate formed of a material other than a resin, when an electric wiring tape is bent to be thermally bonded and fixed, a resin layer having a low thermal conductivity is provided at the bent portion. Accordingly, heat is efficiently transferred to a thermosetting adhesive, and the adhesive is cured within a short time.

In a case where the thermosetting adhesive described in Japanese Patent Application Laid-Open No. 2007-296707 is used for the above-mentioned bonding, since the adhesive is in a liquid state, there is a possibility that the adhesive may extend to the electric connecting portion and electric failure may occur. In addition, it is postulated that there may be a case where curing requires a long time and a high temperature depending on the materials of the electric wiring tape and the electric wiring substrate.

Therefore, an object of the present invention is to provide an ink jet recording head having high reliability in an electric connecting portion of an electric wiring substrate. In addition, another object thereof is to provide a method of manufacturing such an ink jet recording head.

SUMMARY OF THE INVENTION

The present invention is an ink jet recording head including: a recording element substrate including a base provided with an energy generating element that generates energy used for ejecting ink, an ejection orifice provided to correspond to the energy generating element, and an electrode pad electrically connected to the energy generating element; an electric wiring substrate having an electric contact terminal for receiving an electric signal from an ink jet apparatus; an electric wiring tape which electrically connects a terminal electrically connected to the electrode pad, the electric wiring substrate, and the recording element substrate to one another; and an adhesive sheet which fixes the electric wiring substrate and the electric wiring tape to each other, in which the adhesive sheet contains a polyester resin and an epoxy resin.

Further features of the present invention will become apparent from the following description of exemplary embodiments with reference to the attached drawings.

DESCRIPTION OF THE EMBODIMENTS

Hereinafter, the present invention will be described with reference to the drawings.

Figure 1A:
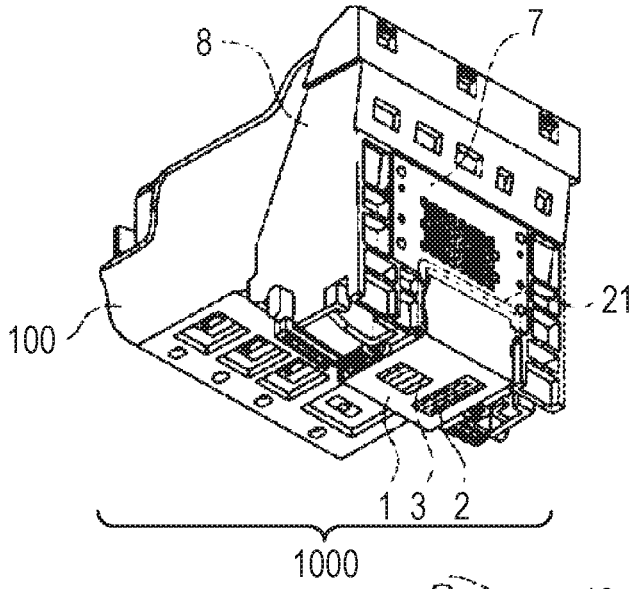
FIG. 1A is a perspective view of a configuration example of an ink jet recording head according to an embodiment of the present invention.
Figure 1B:
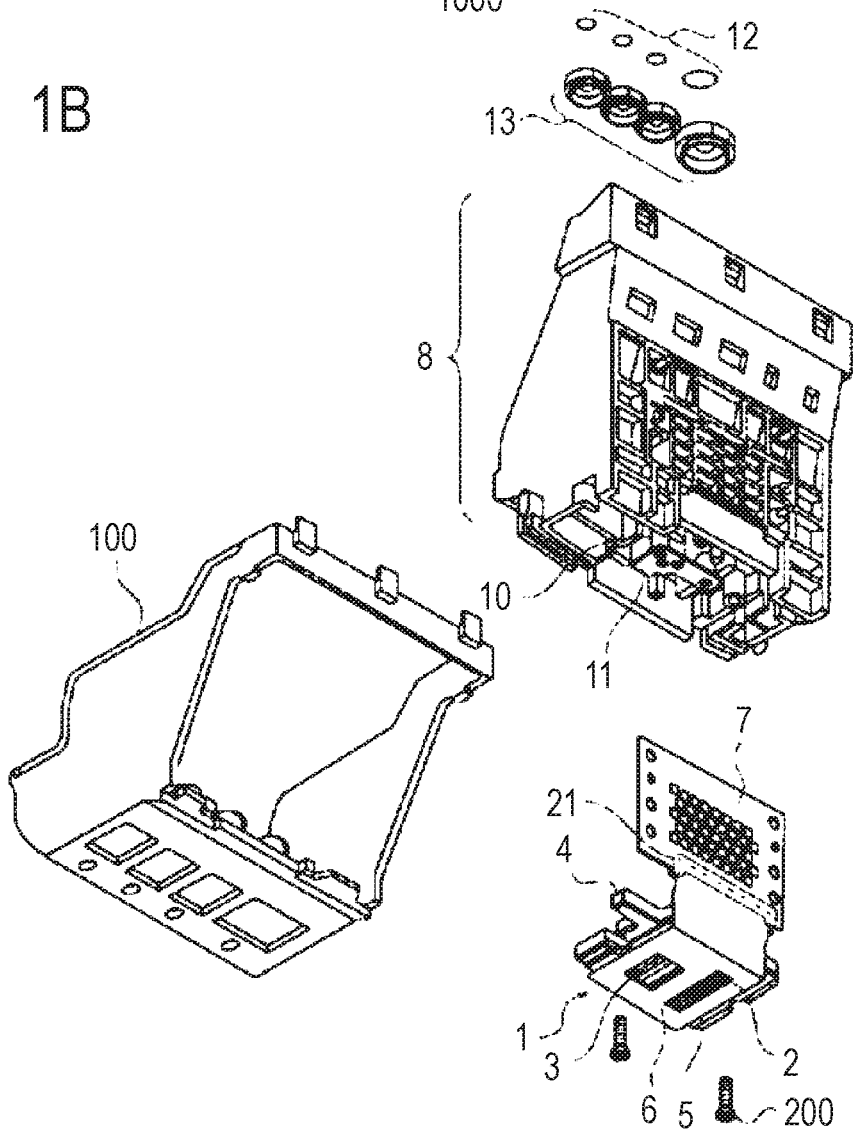
FIG. 1B is an exploded perspective view of the configuration example of the ink jet recording head according to the embodiment of the present invention.
Figure 2:
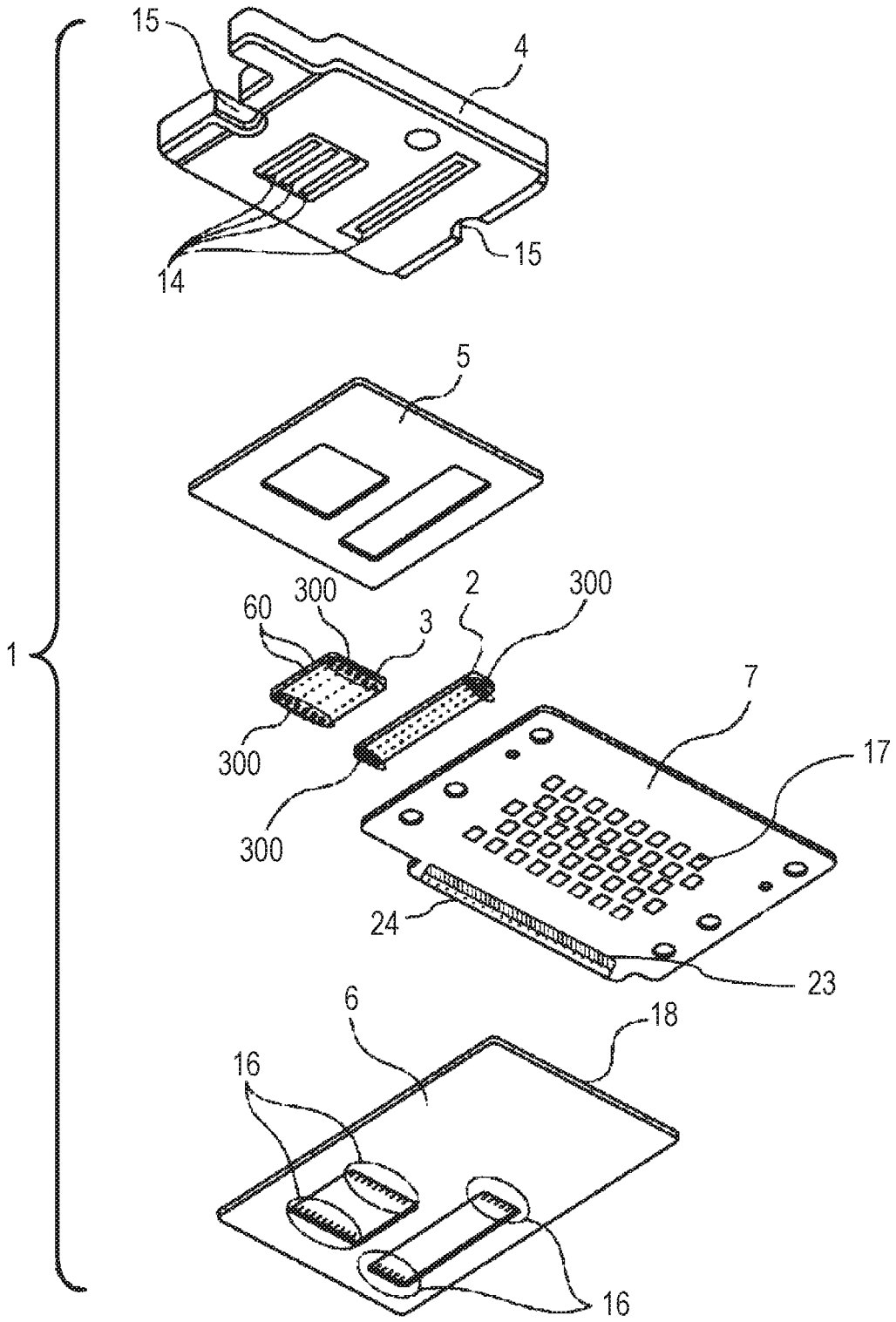
FIG. 2 is a perspective view of a recording element unit of the ink jet recording head illustrated in FIGS. 1A and 1B, which is further disassembled.
Figure 4:
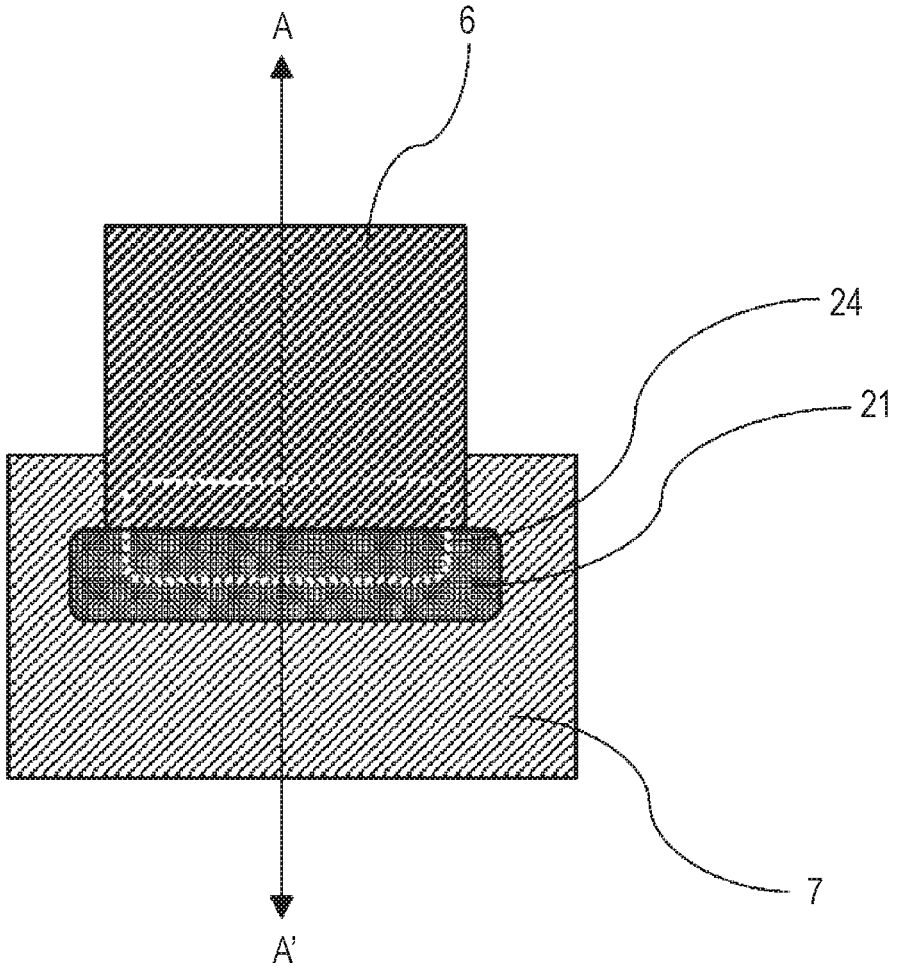
FIG. 4 is a plan view of a sealing portion between the electric wiring tape and the electric wiring substrate.

A perspective view and an exploded perspective view of a configuration example of an ink jet recording head according to an embodiment of the present invention are illustrated in FIGS. 1A and 1B. A perspective view of a recording element unit 1 illustrated in FIGS. 1A and 1B, which is further disassembled, is illustrated in FIG. 2. In addition, FIG. 4 is a plan view of a connecting portion (sealing portion) between an electric wiring tape 6 and an electric wiring substrate 7.

As illustrated in FIG. 1A, and FIG. 1B which is an exploded perspective view of an ink jet recording head 1000 in FIG. 1A, the ink jet recording head 1000 includes an ink supply unit 8, a tank holder 100, and the recording element unit 1. The recording element unit 1 is constituted by a first recording element substrate 2, a second recording element substrate 3, a first plate 4, the electric wiring tape 6, the electric wiring substrate 7, and a second plate 5. The first and second recording element substrates 2 and 3 include energy generating elements that generate energy used for ejecting ink, and ejection orifices for ink corresponding thereto. In addition, the ink supply unit 8 is constituted by an ink supply member (not illustrated), an ink flow path forming member 10, a joint seal member 11, filters 12, and seal rubbers 13. The first plate 4 is fixed to the ink supply unit 8 by a screw 200. An electric connecting portion between the electric wiring substrate 7 and the electric wiring tape 6 is sealed by a sealing member 21.

As illustrated in FIG. 2, in the first plate 4, as supply paths 14, those for supplying black ink to the first recording element substrate 2 and those for supplying cyan, magenta, and yellow ink to the second recording element substrate 3 are formed. In addition, screw fastening portions 15 for connection to the ink supply unit 8 are formed on both side portions thereof. The first and second recording element substrates 2 and 3 include ejection orifices 60 for ink, which are openings corresponding to the energy generating elements (not illustrated) that generate energy used for ejecting ink.

Figure 6:
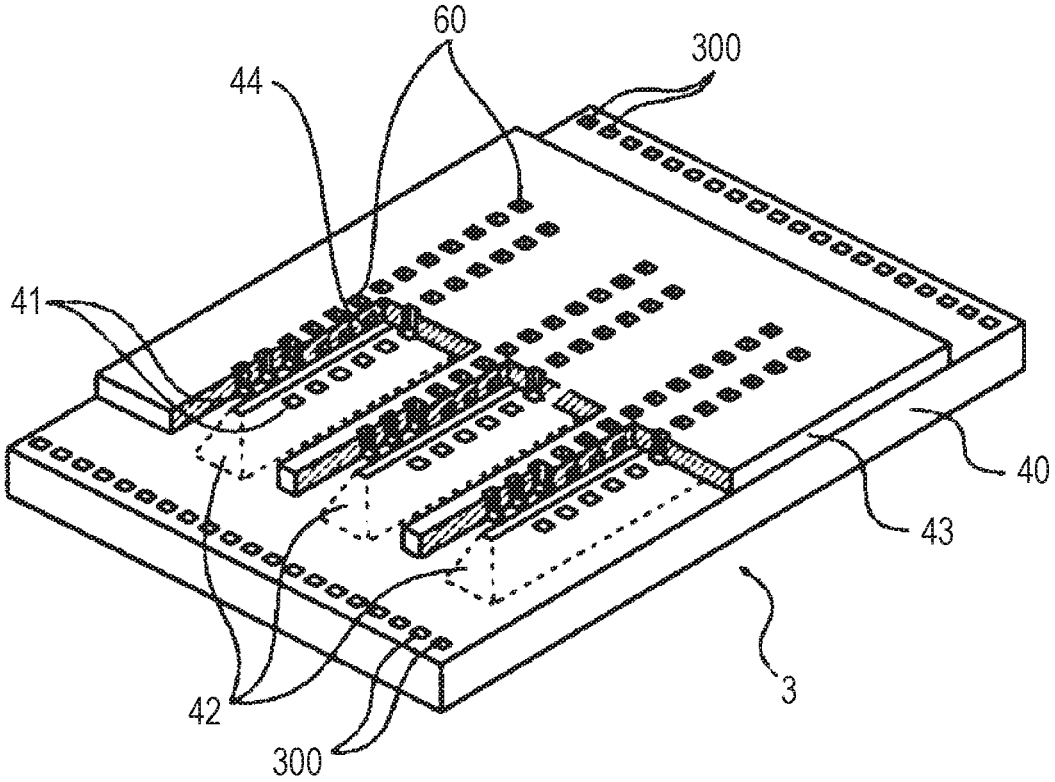
FIG. 6 is a schematic perspective view of an ejection element substrate applicable to the present invention.

FIG. 6 is a schematic perspective view of the second recording element substrate 3 applicable to the present invention. The recording element substrate 3 includes a base 40 made of silicon or the like provided with energy generating elements 41 that generate energy used for ejecting ink, and an ejection orifice member 43 provided with the ejection orifices 60 for ink. In addition, the base 40 is provided with electrode pads 300, and supply orifices 42 for ink, which communicate with ink flow paths 44 leading to the ejection orifices 60 and communicate with the supply paths 14 of the first plate 4. The first recording element substrate 2 has the same structure except for the number of rows of ejection orifices, so that descriptions thereof will be omitted. Although a case where the two recording element substrates are used is described in this embodiment, the embodiment is not limited thereto, and is able to be applied to any case including a case where a single recording element substrate is used and a larger number of recording element substrates are used. Modifications in each case are obvious to those skilled in the art.

Returning to FIG. 2, the second plate 5 has a shape with two openings larger than the outer dimensions of the first recording element substrate 2 and the second recording element substrate 3 adhered and fixed to the first plate 4 by a first adhesive. The second plate 5 is adhered to the first plate 4 by a second adhesive. Accordingly, when the electric wiring tape 6 is adhered, the electric wiring tape 6 is able to come into contact with the adhesive surfaces of the first recording element substrate 2 and the second recording element substrate 3 on a plane and be electrically connected thereto.

The electric wiring tape 6 forms an electric signal path (not illustrated) that applies an electric signal for ejecting ink to the first recording element substrate 2 and the second recording element substrate 3. Two openings respectively corresponding to the recording element substrates 2 and 3 are formed in the electric wiring tape 6. Electrode terminals 16 respectively connected to the electrode pads 300 of the recording element substrates 2 and 3 are formed in the vicinity of the openings. The electrode pads 300 are electrically connected to the energy generating elements that generate energy used for ejecting ink such that the energy for ejecting ink is transmitted to the recording element substrates from the electrode pads 300. In the end portion of the electric wiring tape 6, a second electric connecting terminal portion 18 for electric connection to a first electric connecting terminal portion 23 of the electric wiring substrate 7 having an electric contact terminal 17 for inputting an external signal for receiving the electric signal is formed. The electrode terminals 16 and the second electric connecting terminal portion 18 are connected by a continuous copper foil wiring pattern to constitute the electric signal path. The electric wiring tape 6 is adhered to and fixed to the illustrated surface of the second plate 5 at the rear surface of the illustrated surface by a third adhesive, and furthermore, is bent to one side surface side of the first plate 4 so as to be adhered and fixed to the side surface of the first plate 4 by a thermosetting fourth adhesive.

Electric connection between the electric wiring tape 6 and the first and second recording element substrates 2 and 3 is performed by a thermosonic bonding method through electric bonding between the electrode pads 300 of the recording element substrates 2 and 3 and the electrode terminals 16 of the electric wiring tape 6.

FIG. 4 is a plan view of the sealing portion between the electric wiring tape 6 and the electric wiring substrate 7. As illustrated in FIG. 4, the sealing member 21 covers one surface of the electric wiring tape 6 formed of a polyimide film or the like and one surface of the electric wiring substrate 7 formed of an acrylic resin such as acrylic resin or epoxy acrylate. As a polyimide compound usable for the one surface of the electric wiring tape 6, "UPILEX" (registered trademark, manufactured by Ube Industries, Ltd.) may be used. In addition, the one surface of the electric wiring substrate 7 is a film of the surface covering a wiring portion formed in the electric wiring substrate. As the acrylic resin applicable to this film, "PSR-4000" (trade name, manufactured by Taiyo Ink Mfg. Co., Ltd.) may be used.

Figure 3:
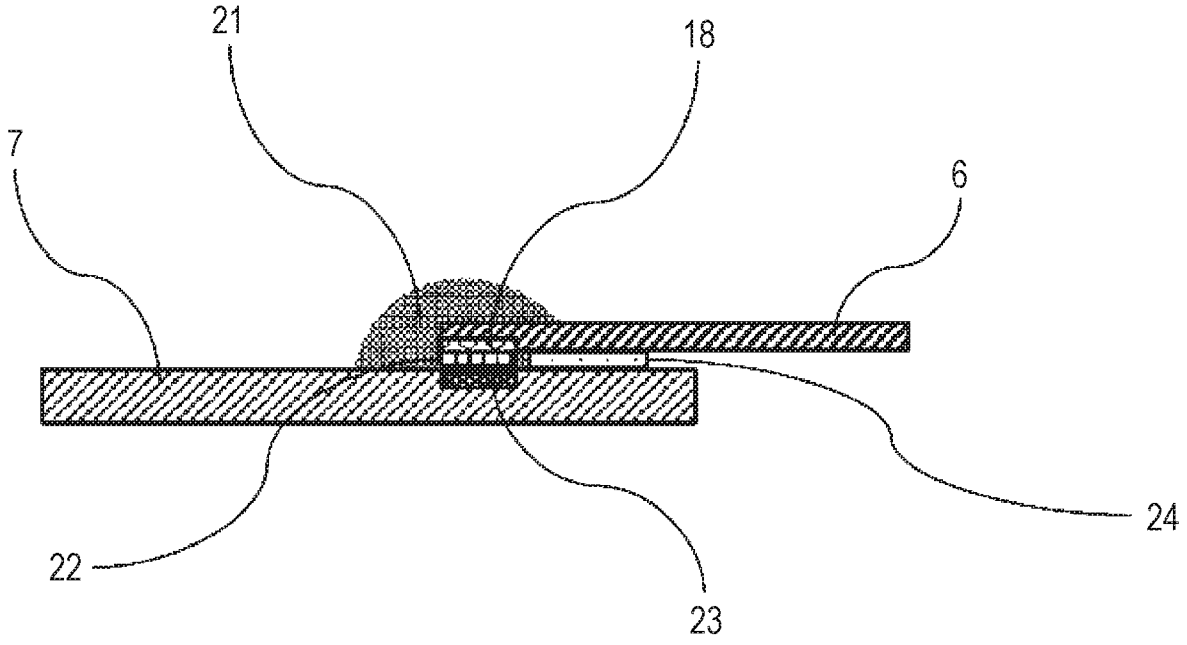
FIG. 3 is a sectional view of an electric wiring tape and an electric wiring substrate after thermocompression bonding.

FIG. 3 is a sectional view of the recording element unit taken along A-A' of FIG. 4 perpendicularly to the electric wiring substrate. As illustrated in FIGS. 3 and 4, the one surface of the electric wiring tape 6 formed of a polyimide film or the like and the one surface of the electric wiring substrate 7 formed of an acrylic resin such as acrylic resin or epoxy acrylate are fixed to each other by being bonded together with an adhesive sheet 24.

The present invention is characterized by the adhesive sheet 24 that fixes the electric wiring tape 6 and the electric wiring substrate 7 together. In the adhesive sheet 24, a sheet surface (adhesive surface) is formed by an adhesive containing a polyester resin and an epoxy resin.

In the present invention, the reason that the reliability of the electric connecting portion of the electric wiring substrate is increased by forming the adhesive surface of the adhesive sheet 24 that fixes the electric wiring tape 6 and the electric wiring substrate 7 together of a polyester resin or an epoxy resin is considered as follows.

Since the adhesive sheet 24 of the present invention contains an epoxy resin, the chemical resistance and heat resistance of the adhesive sheet are improved compared to the related art. In addition, by including the epoxy resin in the adhesive sheet, high adhesive strength is able to be exhibited even in a short heating process, so that the tact time is able to be shortened.

In addition, by including the epoxy resin having a higher softening point than the melting point of the polyester resin, an epoxy group in an unreacted state is able to be contained in the adhesive.

Furthermore, since the adhesive sheet 24 contains the polyester resin, excellent adhesion is able to be exhibited within a short period of time.

For the above reasons, in the present invention, the reliability of the electric connecting portion of the electric wiring substrate is increased.

In the present invention, as an acid component and a polyol component as a copolymerizable monomer forming the polyester resin used for the adhesive sheet 24, the following components may be used. Examples of the acid component include: aromatic dicarboxylic acids such as terephthalic acid, isophthalic acid, orthophthalic acid, 1,4-naphthalenedicarboxylic acid, 1,5-naphthalenedicarboxylic acid, 2,6-naphthalenedicarboxylic acid, 2,7-naphthalenedicarboxylic acid, and biphenyl dicarboxylic acid; aromatic oxycarboxylic acids such as p-oxybenzoic acid and p-(hydroxyethoxy)benzoic acid; saturated aliphatic dicarboxylic acids such as succinic acid, adipic acid, azelaic acid, sebacic acid, dodecane dicarboxylic acid; unsaturated aliphatic dicarboxylic acids such as fumaric acid, maleic acid, and itaconic acid; unsaturated alicyclic dicarboxylic acids such as tetrahydrophthalic acid; alicyclic dicarboxylic acids such as hexahydrophthalic acid, 1,2-cyclohexanedicarboxylic acid, 1,3-cyclohexanedicarboxylic acid, and 1,4-cyclohexanedicarboxylic acid; and tricarboxylic acids such as trimellitic acid, trimesic acid, and pyromellitic acid.

Examples of the polyol component include: aliphatic glycols include ethylene glycol, 1,2-propanediol, 1,3-propanediol, 1,2-butanediol, 1,3-butanediol, 1,4-butanediol, 2,3-butanediol, 1,5-pentanediol, 1,6-hexanediol, neopentyl glycol, 3-methyl-1,5-pentanediol, 2-butyl-2-ethyl-1,3-propanediol; oligoalkylene glycols such as diethylene glycol, triethylene glycol, and dipropylene glycol; alicyclic glycols such as 1,2-cyclohexanedimethanol, 1,3-cyclohexanedimethanol, and 1,4-cyclohexanedimethanol; polyalkylene ether glycols such as polyethylene glycol, polypropylene glycol, and polytetramethylene glycol; triols such as trimethylolethane, trimethylolpropane, glycerin, and pentaerythritol; an ethylene oxide adduct or propylene oxide adduct of bisphenol A; and an ethylene oxide adduct or propylene oxide adduct of hydrogenated bisphenol A.

In the present invention, the polyester resin is able to be produced by dehydration condensation of the acid component and the polyol component.

Furthermore, a commercially available polyester resin may be used in the present invention. Examples thereof include BYRON (trade name) manufactured by Toyobo Co., Ltd., KEMIT (trade name) manufactured by Toray Fine Chemicals Co., Ltd., ARON MELT (trade name) manufactured by Toagosei Co., Ltd., and NICHIGO POLYESTER (trade name) manufactured by Mitsubishi Chemical Corporation.

As the polyester resin, a polyester resin having a melting point lower than the softening point of the epoxy resin is preferable from the viewpoint of including an epoxy group in an unreacted state in the adhesive.

As the epoxy resin, various epoxy resins hitherto known may be used. Examples thereof include bisphenol A epoxy resins, bisphenol F epoxy resins, bisphenol S epoxy resins, and alicyclic epoxy resins.

As the epoxy resin, an epoxy resin which is solid at room temperature (13° C. to 28° C.) is preferable from the viewpoint of including an epoxy group in an unreacted state in the adhesive. In addition, an epoxy resin having a softening point higher than the melting point of the polyester resin may be preferably used.

It is preferable that the adhesive contains 10 parts by mass to 50 parts by mass of the epoxy resin with respect to 100 parts by mass of the polyester resin.

In the adhesive, by setting the amount of the epoxy resin with respect to the total 100 parts by mass of the polyester resin to 10 parts by mass or more, the effect of improving the chemical resistance and heat resistance of the adhesive is able to be more reliably exhibited. In addition, by setting the amount of the epoxy resin with respect to the total 100 parts by mass of the polyester resin to 50 parts by mass or less, it is possible to impart an appropriate melt viscosity to the adhesive.

The adhesive sheet 24 according to the present invention is able to be formed by applying an adhesive composition produced by being melted at a temperature of the melting point of the polyester resin or higher and less than the softening point of the epoxy resin, to a release film.

For example, the release film in the present invention is able to be formed of a film made of a resin having good affinity with the adhesive. Particularly, a film made of a polyethylene terephthalate resin or a polyethylene naphthalate resin is suitable.

Next, an example of a manufacturing method including a step of adhering the adhesive sheet 24, and a step of applying the sealing member 21 after the adhesion and heating the resultant at 100° C. or higher for one hour or longer will be described using FIG. 3.

The adhesive sheet 24 is cut into a rectangular sheet piece, and the adhesive surface thereof in a state with the release film (not illustrated) attached thereto is placed on the electric wiring substrate 7, and a fluororesin sheet (not illustrated) such as Teflon (registered trademark) is placed on the release film. Thermocompression bonding is performed on the fluororesin sheet, the release film is peeled off, and the electric wiring tape 6 is placed thereon. A fluororesin sheet is placed on the electric wiring tape 6, and thermocompression bonding is performed thereon. The end portion of the electric wiring tape 6 and the electric wiring substrate 7 are subjected to thermocompression bonding using an anisotropic conductive film 22 or the like so as to be electrically connected to each other. Thereafter, the sealing member 21 is sealed in the peripheral edge portion of the front side of the electric connecting portion between the electric connecting terminal portion of the electric wiring tape 6 and the connecting terminal of the electric wiring substrate 7.

The adhesive sheet according to the present invention is heated to 100° C. or higher for one hour or longer after the thermocompression bonding such that unreacted epoxy groups are further reacted and higher adhesive strength is able to be exhibited. This may be checked by differential scanning calorimetry (DSC) from the fact that the reaction of the unreacted epoxy groups remaining even after the thermocompression bonding has progressed in the heating step at 100° C. or higher for one hour or longer.

EXAMPLES

Hereinafter, examples will be described to describe the present invention in more detail, but the technical scope of the present invention is not limited thereto.

Example 1

10 parts by mass of a bisphenol A epoxy resin having a softening point of 130° C. was melted in 100 parts by mass of a polyester resin having a melting point of 100° C. An adhesive composition produced as above was applied to a release film and thereafter dried, thereby producing an adhesive sheet having a thickness of about 50 μm. A rectangular sheet piece having a side of 5 mm was cut out, and the adhesive surface in a state with the release film attached thereto was placed on an electric wiring substrate formed of an acrylic resin. Next, a sheet (hereinafter, referred to as PTFE sheet) made of Teflon (registered trademark) having a thickness of 50 μm was placed on the release film. Compression bonding was performed on the PTFE sheet having a thickness of 50 μm at a tool temperature of 140° C. and a pressing pressure of 0.15 MPa for 10 seconds. The release film was peeled off, and an electric wiring tape was placed thereon. A PTFE sheet having a thickness of 50 μm was placed on the electric wiring tape formed of a polyimide film, compression bonding was performed thereon at a tool temperature of 200° C. and a pressing pressure of 0.15 MPa for 20 seconds, and the electric wiring substrate and the electric wiring tape were adhered and fixed to each other with the adhesive sheet.

Example 2

The electric wiring substrate and the electric wiring tape were adhered and fixed to each other with the adhesive sheet in the same manner as in Example 1 except that the amount of the bisphenol A epoxy resin with respect to 100 parts by mass of the polyester resin was set to 50 parts by mass.

Example 3

The electric wiring substrate and the electric wiring tape were adhered and fixed to each other with the adhesive sheet in the same manner as in Example 1 except that heating was further performed at 100° C. for one hour after the end of the operation of Example 1.

Example 4

The electric wiring substrate and the electric wiring tape were adhered and fixed to each other with the adhesive sheet in the same manner as in Example 3 except that heating was further performed at 100° C. for one hour after the end of the operation of Example 3.

Comparative Example 1

The electric wiring substrate and the electric wiring tape were adhered and fixed to each other with the adhesive sheet in the same manner as in Example 1 except that the adhesive sheet having a thickness of about 50 μm was produced by melting the polyester resin having a melting point of 100° C., applying the polyester resin to the release film, and drying the resultant.

Comparative Example 2

The electric wiring substrate and the electric wiring tape were adhered and fixed to each other with the adhesive sheet in the same manner as in Example 3 except that as the adhesive sheet, a commercially available epoxy thermosetting adhesive sheet was used.

Comparative Example 3

The electric wiring substrate and the electric wiring tape were adhered and fixed to each other with the adhesive sheet in the same manner as in Example 3 except that as the adhesive sheet, a commercially available double-sided pressure-sensitive adhesive sheet (double-sided pressure-sensitive adhesive tape 9660 made by Sumitomo 3M Limited.) was used.

(Process Compatibility Evaluation)

In examples and comparative examples, immediately after the compression bonding of the electric wiring substrate and the electric wiring tape, the electric wiring tape was peeled in a direction of 90 degrees at a speed of 10 mm/min, and the peeling strength was measured using a peel tester and evaluated based on (Evaluation Criteria) as follows. In cases of Example 3, Example 4, Comparative Example 2, and Comparative Example 3, evaluation was performed immediately after heating at 100° C. for one hour. The results are shown in Table 1.

(Evaluation Criteria)

A: Peeling strength 20 N/cm or more

B: Peeling strength 1 to 20 N/cm

C: Peeling strength 0 to 1 N/cm (Adhesiveness)

In the examples and the comparative examples, the electric wiring substrate and the electric wiring tape fixed to each other with the adhesive sheet were immersed in ink (BCI-371 M manufactured by Canon Inc.) and heated and maintained in a thermostat at 70° C. for one week. After extraction from the thermostat, the electric wiring tape was peeled in a direction of 90 degrees at a speed of 10 mm/min, and the peeling strength was measured using the peel tester and evaluated based on (Evaluation Criteria) as follows. The results are shown in Table 1.

(Evaluation Criteria)

AA: Peeling strength 30 N/cm or more

A: Peeling strength 20 to 30 N/cm

B: Peeling strength 1 to 20 N/cm (Ink Resistance)

In the examples and comparative examples, after the adhesiveness evaluation, the peeled adhesive surface was visually observed with a metallurgical microscope to examine the presence or absence of ink penetration, and evaluation was performed based on (Evaluation Criteria) as follows. The results are shown in Table 1.

(Evaluation Criteria)

A: No ink penetration

C: Peeling and ink penetration present

TABLE 1

| | Process compatibility | Adhesiveness | Ink resistance |
|---|---|---|---|
| Example 1 | A | A | A |
| Example 2 | A | A | A |
| Example 3 | A | AA | A |
| Example 4 | A | AA | A |
| Comparative Example 1 | B | B | C |
| Comparative Example 2 | C | A | A |
| Comparative Example 3 | B | B | C |

In the evaluation of process compatibility in Table 1, in all of the examples, good peeling strength between the electric wiring substrate and the electric wiring tape was checked. In addition, in Comparative Examples 1 and 3, peeling strengths of 1 to 20 N/cm were checked immediately after compression bonding, but both were lower than those of the examples. Immediately after compression bonding in Comparative Example 2, the adhesive strength between the electric wiring substrate and the electric wiring tape was insufficient, and peeling had occurred.

Figure 5A:
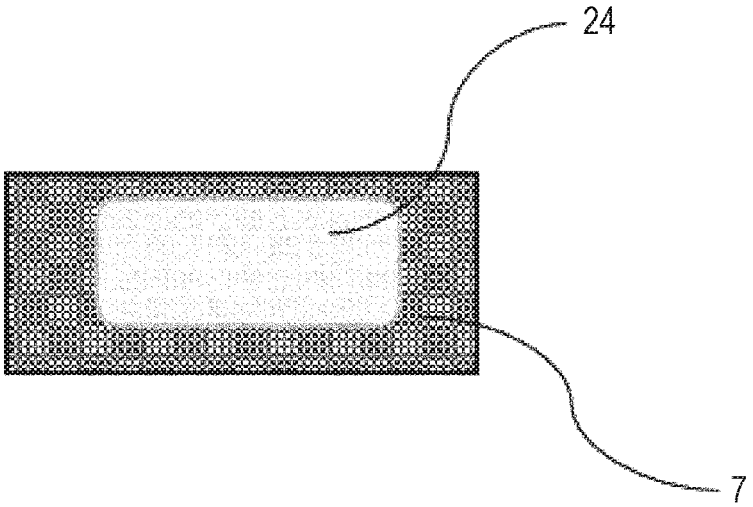
FIG. 5A is a view illustrating an adhesive surface state of an example after immersion in ink.
Figure 5B:
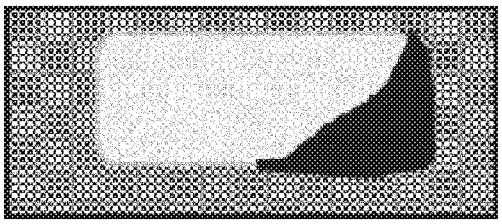
FIG. 5B is a view illustrating an adhesive surface state of a comparative example after immersion in ink.

In addition, in the evaluation of adhesiveness and ink resistance in Table 1, Examples 1 to 4 had good peeling strength and had no ink penetration into the adhesive surface as illustrated in FIG. 5A. Examples 3 and 4 had better peeling strength than Examples 1 and 2. It is considered that this is because in Examples 3 and 4, unreacted epoxy groups had reacted in the heating step at 100° C. for one hour after thermocompression bonding and higher adhesive strength was exhibited. In Comparative Examples 1 and 3, after the immersion in the ink, peeling had occurred as illustrated in FIG. 5B, ink penetration into the peeled surface was seen.

In Comparative Example 2, in the evaluation of adhesiveness and ink resistance, peeling had not occurred, and there was no ink penetration. However, in the evaluation of process compatibility, the adhesive strength immediately after compression bonding was insufficient, and peeling had occurred.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-034902, filed Feb. 28, 2018, which is hereby incorporated by reference herein in its entirety.

What is claimed is:

1. An ink jet recording head comprising:

a recording element substrate including a base provided with an energy generating element that generates energy used for ejecting ink, an ejection orifice provided to correspond to the energy generating element, and an electrode pad electrically connected to the energy generating element;

an electric wiring substrate having an electric contact terminal for receiving an electric signal from an ink jet apparatus;

an electric wiring tape which electrically connects a terminal electrically connected to the electrode pad, the electric wiring substrate, and the recording element substrate to one another; and an adhesive sheet which fixes the electric wiring substrate and the electric wiring tape to each other, wherein the adhesive sheet contains a polyester resin and an epoxy resin, and wherein a softening point of the epoxy resin is higher than a melting point of the polyester resin.

2. The ink jet recording head according to claim 1, wherein the adhesive sheet contains 10 to 50 parts by mass of the epoxy resin with respect to 100 parts by mass of the polyester resin.

3. An ink jet recording head comprising:

a recording element substrate including a base provided with an energy generating element that generates energy used for ejecting ink, an ejection orifice provided to correspond to the energy generating element, and an electrode pad electrically connected to the energy generating element;

an electric wiring substrate having an electric contact terminal for receiving an electric signal from an ink jet apparatus;

an electric wiring tape which electrically connects a terminal electrically connected to the electrode pad, the electric wiring substrate, and the recording element substrate to one another; and an adhesive sheet which fixes the electric wiring substrate and the electric wiring tape to each other, wherein the adhesive sheet contains a polyester resin and an epoxy resin, and wherein the epoxy resin is a solid at room temperature.

4. The ink jet recording head according to claim 3, wherein the adhesive sheet contains 10 to 50 parts by mass of the epoxy resin with respect to 100 parts by mass of the polyester resin.

5. A method of manufacturing an ink jet recording head including a recording element substrate including a base provided with an energy generating element that generates energy used for ejecting ink, an ejection orifice provided to correspond to the energy generating element, and an electrode pad electrically connected to the energy generating element, an electric wiring substrate having an electric contact terminal for receiving an electric signal from an ink jet apparatus, and an electric wiring tape which electrically connects a terminal electrically connected to the electrode pad, the electric wiring substrate, and the recording element substrate to one another, the method comprising:

a step of adhering and fixing the electric wiring substrate and the electric wiring tape to each other with an adhesive sheet containing a polyester resin and an epoxy resin; and after the step of adhering and fixing, a step of heating the electric wiring substrate and the electric wiring tape at 100° C. or higher for one hour or longer.

6. The method according to claim 5, wherein the adhesive sheet contains 10 to 50 parts by mass of the epoxy resin with respect to 100 parts by mass of the polyester resin.

7. The method according to claim 5, wherein a softening point of the epoxy resin is higher than a melting point of the polyester resin.

8. The method according to claim 5, wherein the epoxy resin is a solid at room temperature.

* * * * *